United States Patent [19]

Tsuji

[11] 4,122,661

[45] Oct. 31, 1978

[54] ELECTRONIC TIMEPIECE DIGITAL DISPLAY DRIVE CIRCUIT

[75] Inventor: Masuo Tsuji, Suwa, Japan

[73] Assignee: Kabushiki Kaisha Suwa Seikosha, Tokyo, Japan

[21] Appl. No.: 767,094

[22] Filed: Feb. 9, 1977

[30] Foreign Application Priority Data

Feb. 9, 1976 [JP] Japan ..... 51-12975

[51] Int. Cl.[2] ..... G04C 3/00

[52] U.S. Cl. ..... 58/23 R; 340/336

[58] Field of Search ..... 58/23 R, 23 BA, 50 R; 340/324 M, 336; 350/160 LC

[56] References Cited

U.S. PATENT DOCUMENTS

| | | | |
|---|---|---|---|
| 3,701,249 | 10/1972 | Bergey et al. | 58/50 R |
| 3,845,615 | 11/1974 | Cake | 58/50 R |
| 3,912,977 | 10/1975 | Fillmore | 58/23 BA |
| 3,947,721 | 3/1976 | Suenami et al. | 340/336 |
| 4,011,002 | 3/1977 | Ebihara et al. | 350/160 LC |

*Primary Examiner*—Edith S. Jackmon

*Attorney, Agent, or Firm*—Blum, Moscovitz, Friedman & Kaplan

[57] ABSTRACT

An electronic timepiece having detecting and control circuitry for preventing a digital display from being driven by a DC energizing signal is provided. The detecting and controlling circuitry is coupled intermediate the decoder circuitry and driving circuitry in an electronic timepiece digital display arrangement and detects the presence or absence of an intermediate frequency signal being produced by the timekeeping circuitry and applied to the driver circuitry to effect AC driving of the digital display. In response to detecting the absence of an intermediate frequency signal applied to the driver circuitry, the detecting and controlling circuit prevents the decoder circuitry from applying to the driver circuitry decoded timekeeping signals for effecting driving of the digital display, and thereby prevents inadvertent DC driving of the digital display.

11 Claims, 6 Drawing Figures

ELECTRONIC TIMEPIECE DIGITAL DISPLAY DRIVE CIRCUIT

BACKGROUND OF THE INVENTION

This invention is directed to electronic timepiece circuitry for driving a liquid crystal display cell, and, in particular, to detection and control circuitry for detecting the presence or absence of an AC energizing signal applied to the digital display drive circuitry in order to prevent energization of the digital display elements in the absence of a AC signal being detected.

While electronic timepiece digital displays have taken on various forms, one preferred form is a digital display comprised of liquid crystal display cells. Liquid crystal display cells are particularly desirable because of their low current consumption and durability. In order to obtain these benefits, of liquid crystal display cells, it is necessary to effect AC driving of the liquid crystal display cells, and hence, to provide appropriate AC drive circuitry therefor. Nevertheless, because such AC drive circuitry requires the presence of an AC energizing signal produced by the timekeeping circuitry, if, for any reason, the timekeeping circuitry fails to produce a sufficiently high frequency AC energizing signal, the liquid crystal display cells are DC driven, thereby effecting a rapid deterioration of the respective display cells. In fact, such AC driving is selected in order to avoid the rapid deterioration in the liquid crystal display cells that results from DC driving. The instant invention is particularly characterized by detecting and control circuitry for preventing DC driving of liquid crystal display cells in the absence of a AC driving signal being produced by the timekeeping circuitry of the timepiece.

SUMMARY OF THE INVENTION

Generally speaking, in accordance with the invention, a liquid crystal digital display electronic timepiece having detecting and control circuitry for preventing the digital display from being driven in a DC mode is provided. Timekeeping circuitry is provided for producing timekeeping signals, representative of actual time and at least one intermediate frequency signal. Decoder circuitry is coupled to the timekeeping circuitry to receive the timekeeping signals and, in response thereto, produce a plurality of decoded timekeeping signals. Driver circuitry is adapted to receive the intermediate frequency signal and the plurality of decoded timekeeping signals, and in response thereto produce a plurality of intermediate frequency display drive signals. A digital display is energized to display actual time in response to each of the intermediate frequency drive signals being applied thereto. The instant invention is particularly characterized by detecting and control circuitry coupled intermediate the decoder circuitry and the driving circuitry for receiving the intermediate frequency signal and in response to detecting the absence of an intermediate frequency, being adapted to inhibit each of the decoded timekeeping signals from being applied to the driving circuitry to thereby prevent the digital display from being energized.

Accordingly, it is an object of the instant invention to provide an improved electronic timepiece liquid crystal digital display drive circuit.

Still a further object of the instant invention is to reduce deterioriation of the liquid crystal display cells in an electronic timepiece liquid crystal digital display by preventing same from being driven in a DC mode.

Still another object of the instant invention is to provide improved electronic timepiece drive circuitry capable of detecting when the timekeeping circuitry ceases to apply an AC energizing signal to the display drive circuitry and in response thereto prevents the application of DC drive signals to the liquid crystal digital display.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
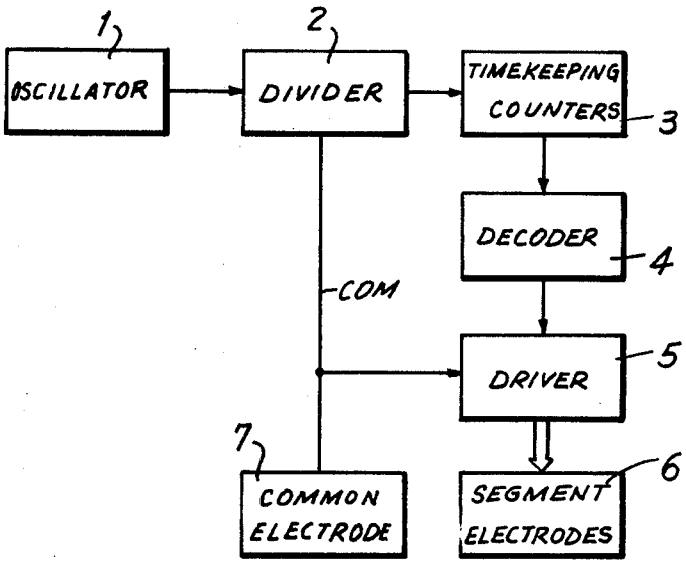
FIG. 1 PRIOR ART
FIG. 1 is a block circuit diagram of a liquid crystal digital display electronic timepiece constructed in accordance with the prior art.

Reference is now made to FIG. 1, wherein a small-size liquid crystal digital display electronic timepiece, such as a wristwatch, constructed in accordance with the prior art, is depicted. The oscillator circuit 1, divider circuit 2 and timekeeping counters 3 comprise the timekeeping circuitry of the electronic timepiece. The oscillator circuit 1 is a C-MOS oscllator circuit having a quartz crystal vibrator as a time standard, to thereby apply to the divider circuit 2 a high frequency time standard signal having a frequency on the order of $2^{15}$ Hz. The divider circuit 2 is a conventional divide-down circuit comprised of a plurality of series connected binary divider stages for receiving the high frequency time standard signal produced by the oscillator circuit 1 and dividing same down into a low frequency timing signal having a period on the order of one second. Additionally, each divider stage is capable of producing an intermediate frequency signal of a different frequency such as intermediate frequency signal COM. The low frequency timing signal, produced by the divider circuitry 2, is applied to the timekeeping counters 3, which timekeeping counters are comprised of decadic and hexadic counters capable of producing timekeeping signals representative of seconds, tens of seconds, minutes, tens of minutes, hours and tens of hours.

In order to convert the timekeeping signals produced by the timekeeping counters 3 from BCD signals to digital display drive signals, decoder circuitry is provided for receiving each of the timekeeping signals produced by the respective timekeeping counters and decoding same to thereby produce decoded timekeeping signals to be applied to a driver circuit 5. The driver circuit 5 is coupled to each of the liquid crystal display segment electrodes 6 comprising the liquid crystal digital display and, in the manner discussed in detail below, is adapted to effect driving of the liquid crystal digital display in an AC driving mode.

The liquid crystal digital display is ordered into conventional seven-bar liquid crystal display digits wherein the liquid crystal display segment electrodes 6 form the seven-bar display digits, and a common electrode 7 is commonly spaced from each of the respective liquid crystal display segment electrodes 6 forming the display digits. Each liquid crystal display cell is comprised of a liquid crystal display segment electrode, the common electrode spaced therefrom and a liquid crystal composition (not shown) disposed between said spaced apart electrodes. Energizing of the respective display cells is effected by applying to the respective opposed electrodes comprising each display cell, signals of opposing polarity.

Moreover, by consistently reversing the respective orientations of the display segment electrodes and the common electrodes, with respect to each other, known as AC driving, no deterioration of the liquid crystal display cells results from the energizing of same. However, when the liquid crystal display cells are driven in a DC mode, such DC driving results in a rapid deterioration of the respective display cells.

An intermediate frequency signal COM is therefore selected at a frequency to obtain AC driving of the liquid crystal display segments. Although it is preferred that the intermediate frequency signal COM be produced by the divider circuitry, it is possible for the intermediate frequency signal to be produced by the oscillator circuitry. The intermediate frequency signal COM is applied to the driver circuitry 5 in order to effect selection of the decoded timekeeping signal to be applied to the liquid crystal display segment electrodes 6, and additionally, is directly applied to the common electrode 7.

Figure 2:
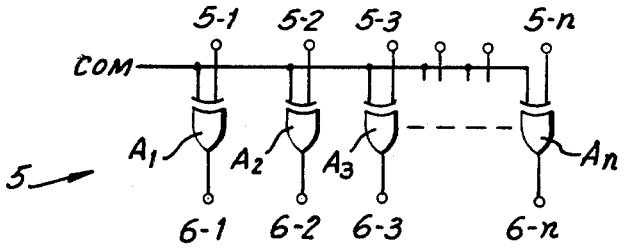
FIG. 2 PRIOR ART
FIG. 2 is a circuit diagram of a DC driver circuit constructed in accordance with the prior art.

Reference is specifically made to FIG. 2, wherein the driver circuit 5 is depicted in greater detail. The intermediate frequency signal COM is applied to the input of each of the EXCLUSIVE OR gates $A_1$ through $A_n$. The other input to each of the respective EXCLUSIVE OR gates $A_1$ through $A_n$ are the decoded timekeeping signals 5-1 through 5-n produced by the decoder circuitry in response to the BCD timekeeping signals produced by the respective seconds, minutes and hours timekeeping counters 3. The outputs 6-1 through 6-n of the respective EXCLUSIVE OR gates $A_1$ through $A_n$ are applied to the liquid crystal display segment electrodes to effect energization of the respective display cells. The outputs 6-1 through 6-n, of the respective EXCLUSIVE OR gates $A_1$ through $A_n$, are of opposite phase from the intermediate frequency signal COM applied to the common electrode, when the digital display cells are energized, and are of the same phase (or polarity) as the intermediate frequency signal when the respective segments formed by each of the liquid crystal display cells are not energized. The EXCLUSIVE OR gates insure that the respective display segments will not be energized unless the signals applied to the respective segment electrodes and common electrode, forming each display cell, are of opposite phase by preventing the decoded timekeeping signals from being applied to the segment electrode, unless such a condition is desired. Moreover, the driver circuit 5 insures that the respective liquid crystal display cells are driven in an AC driving mode.

As previously noted, in the absence of the AC intermediate frequency energizing signal COM, a DC voltage would be applied across the segment electrodes and common electrodes comprising each of the display segments, thereby effecting a deterioration of the liquid crystals and the electrodes utilized to define the respective display cells. Experimental tests have shown that the application of a DC signal to a liquid crystal display cell will result in deterioration of the liquid crystal display cell after a week, and at least within the first month, when a DC voltage of 3V is applied thereto. Moreover, a rise in current consumption per $1CM_2$ from 20nA to several $\mu$A also occurs.

It is therefore necessary that the intermediate frequency energizing signal COM be applied to the driver circuit 5 in order to insure that the digital display is driven in a AC driving mode. Moreover, a preferred frequency for the intermediate frequency energizing signal is on the order of 32 Hz since such a frequency offers the best compromise with respect to current consumption and flickering of the digital display segments. Specifically, the higher the frequency utilized to drive the liquid crystal display cells, the greater the amount of current required to drive the respective display cells. However, the desire to minimize current consumption must be balanced with the ability of the human eye to detect flickering of the respective display cells when the frequency, at which the same are energized, is reduced.

It has been found, however, that liquid crystal electronic timepieces of the type illustrated and described above have a particular disadvantage since a malfunction in the timekeeping circuitry can result in the liquid crystal display cells being driven in a DC driving mode, and hence rapidly deteriorated before the electronic timepiece can be repaired. For example, it is not unlikely that a sudden shock will cause a break in the wiring between the quartz crystal, capacitor or other elements that are hard-wired to the quartz crystal oscillator circuitry. A more likely occurrence is the lowering of the effective voltage delivered to the oscillator circuitry by the battery, when the battery utilized to energize the timepiece is nearly exhausted, thereby resulting in the inability of the oscillator circuit to oscillate and, hence, produce an alternating frequency signal. In the conventional digital display electronic timepiece, illustrated in FIGS. 1 and 2, if, for any reason, the oscillator circuit fails to produce an oscillating signal, a DC voltage would continue to be applied to certain of the respective liquid crystal display cells and thereby effect a deterioration thereof.

Moreover, if the circuitry comprising the divider circuit and driving circuit is comprised of C-MOS transistors, leakage currents result in a current conumption of less than 0.2 $\mu$A when the oscillator stops producing oscillating signals. Thus, for the case illustrated above, wherein a wiring failure in the oscillator circuit causes the oscillating signal not to be produced thereby, and a 1.5V DC cell is energizing the timepiece, a DC voltage could be applied to the liquid crystal display cell for as much as two years, thereby deteriorating same. Moreover, in the situation detailed above, wherein the voltage delivered by the DC battery of the wristwatch drops to 1.0V, said drop will cause the oscillator circuit to cease oscillation, and permit a DC voltage to be delivered to the liquid crystal display cell for at least two months.

The speed at which deterioration of liquid crystal display cells is effected by being driven in a DC mode depends on the magnitude of the applied voltage, and the smaller the magnitude, the slower the deterioration. Once such deterioration occurs, it then is not only necessary to replace the battery or repair the break point in the oscillator circuit, but it is further necessary to change the liquid crystal display panel in the electronic timepiece. Accordingly, the instant invention is directed to eliminating the deterioration that can likely be caused by the DC driving of the liquid crystal display cells when the oscillator circuit fails to produce an oscillating signal.

Figure 3:
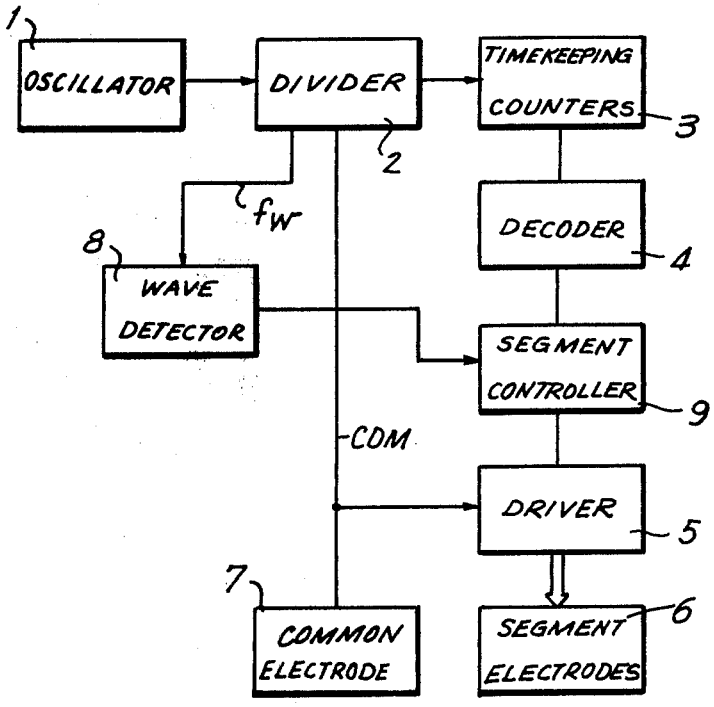
FIG. 3 is a block circuit diagram of a liquid crystal digital display electronic timepiece constructed in accordance with a preferred embodiment of the instant invention.

Reference is now made to FIG. 3, wherein a liquid crystal digital display electronic timepiece, having detector and control circuitry in accordance with the instant invention, is depicted, like reference numerals being utilized to denote like elements described above. A wave detector circuit 8 is coupled to the divider circuit 2 to receive the intermediate frequency signal COM or, as illustrated in FIG. 3, a further intermediate frequency signal $f_w$ produced by the divider circuit 2. Detector circuit 8 is coupled to a segment controller 9, which segment controller in response to the wave detector circuit 8 detecting the absence of an alternating signal being produced by the divider circuit, prevents the decoded timekeeping signals produced by the decoder circuit 4 from being applied to the driver circuit 5, and hence to the liquid crystal display segment electrodes 6. By preventing the decoded timekeeping signals from being applied to the liquid crystal display segments by the driver circuitry, when the absence of an oscillating signal, produced by the oscillator circuit, is detected, the voltages applied to the respective electrodes of each display cell will be of the same phase, and thereby effect a net voltage across the respective display cell electrodes of 0, and thereby avoid any deterioration from being effected thereat.

Figure 4:
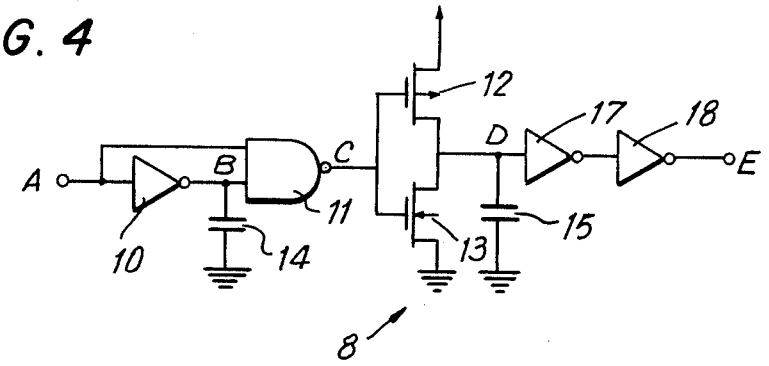
FIG. 4 is a circuit diagram of a wave detecting circuit constructed in accordance with a preferred embodiment of the instant invention.

Reference is particularly made to FIG. 4, wherein a preferred embodiment of the wave detector circuit 8 is depicted. The detector circuit 8 includes C-MOS inverters 10, 17 and 18, NAND gate 11 also comprised of C-MOS transistors, P-channel transistor 12 and capacitors 14 and 15. As is noted below, although the P-channel transistor 12 is complementary coupled to a N-channel transistor 13, to form still a further inverter stage, the N-channel transistor 13 can be replaced by a fixed resistance or other suitable element.

Figure 5:
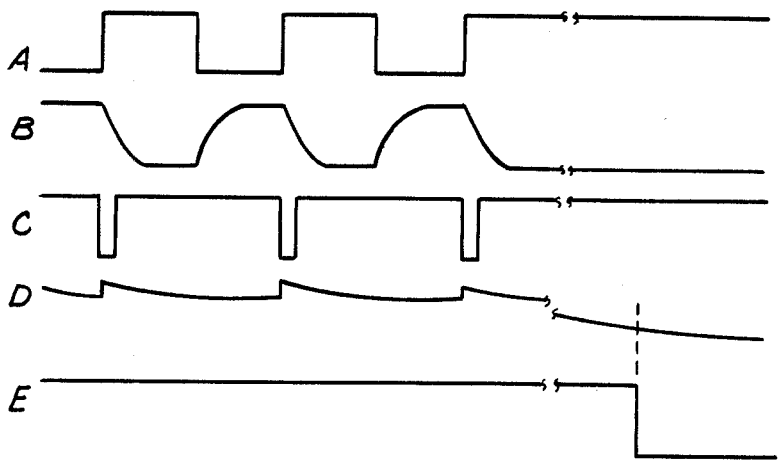
FIG. 5 is a comparative wave diagram illustrating the operation of the wave detecting circuitry depicted in FIG. 4.

As illustrated in FIG. 5, the operation of the wave detector circuit 4 is as follows. When an AC rectangular wave signal, such as the intermediate frequency energizing signal COM produced by the divider circuitry, or a further intermediate frequency signal $f_w$ produced by the divider circuitry, is applied at the input A of the wave detector circuit, the inverter 10 produces an inverted and slightly delayed output signal B, the delay in the output signal being effected by the RC constant resulting from the forward resistance of the inverter circuit and the capacitance of the capacitor 14. Thereafter, the intermediate frequency signal A and the delayed out-of-phase inverted signal B are applied to NAND gate 11, to thereby produce a reduced duty cycle output signal C having a short rectangular pulse occurring at the beginning of each cycle of the rectangular wave applied to the wave detector circuit. When the short, LOW level pulses of the output signal C are applied to P-channel transistor 12 and N-channel transistor 13, the P-channel transistor 12 is turned ON during the short LOW level pulse interval of the signal C, to thereby effect a charging of the capacitor 15 while the P-channel transistor is turned ON. However, once the P-channel transistor is turned OFF, the capacitor 15 discharges through the N-channel transistor 13. Accordingly, the signal D, applied at the input of inverter 17, rises to a peak level when the P-channel transistor 12 is turned ON and, hence, the capacitor 15 sees a substantially zero impedance thereat, and the capacitor 15 is discharged when it sees a high or substantially infinite impedance in the P-channel transistor 12, when the transistor is turned OFF. Moreover, once the intermediate frequency rectangular wave signal A is no longer applied to the input A of the wave detector circuit, the level of the signal D continues to drop, thereby causing a different binary state output at the output of inverter 18. When the output signal E drops from the level at which same is maintained when as intermediate frequency rectangular wave signal is applied thereto, to a substantially lower level, this level is utilized as a detection signal to be applied to the segment controller circuit 9 to inhibit the application of decoded timekeeping signals to the driver circuit in a manner to be discussed in greater detail below. As noted above, the N-channel transistor 13 can be replaced by a single resistive means having a fixed resistance since the capacitor 15 can be charged and discharged solely through the P-channel transistor 12 by the respective turning on and turning OFF thereof.

As illustrated in the wave diagrams of FIG. 5, if the ON-resistance of the N-channel transistor 13 is 50 NΩ and the capacitor 15 is on the order of 10 PF, a time constant of 0.5 M-sec. results. When a rectangular wave $f_w$, on the order of 20K Hz is applied to the input A of the wave detector circuit, the voltage level of the signal D is decayed to about 9/10 of the highest level to thereby keep the voltage level of the signal D above the threshold level of the C-MOS inverter 17, and thereby insure that a HIGH level ouput E is produced at the output of C-MOS inverter 18. Accordingly, the detecting signal E is maintained at a high level when a rectangular wave, on the order of 20K Hz, is applied to the wave detector circuit and drops to a LOW level signal after 0.5 m-sec. when the signal produced by the divider circuitry, and applied to the wave detector, is not a rectangular wave AC signal.

It should be noted that in order to obtain the above result, the ON-resistance of the P-channel MOS transistor must be negligible so that a current consumption of about 0.5 μA obtains when the circuitry is operated at a voltage of 1.5V. Moreover, in order to insure that a sufficient delay at the output B of the inverter 10 occurs, either a plurality of inverters of even number can be connected in series between the inverter 10 and the capacitor 14, or the ON-resistance of the N-channel transistor comprising the inverter 10 and the capacitance of the capacitor 14 can be made sufficiently high to effect the necessary delay.

Figure 6:
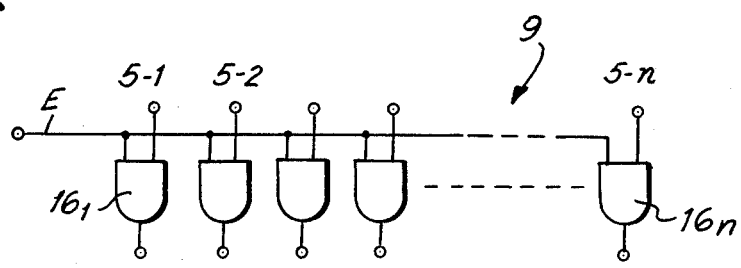
FIG. 6 is a circuit diagram of a segment control circuit constructed in accordance with a preferred embodiment of the instant invention.

Referring, finally, to FIG. 6, the segment controller 9, for preventing the application of decoded timekeeping signals to the driver circuit 5 in response to the detecting signal E being applied thereto, is depicted.

The segment controller 9 is comprised of AND gates $16_1$ through $16_n$, which AND gates receive, as a first input, the detecting signal E produced by the wave detector circuit 8. The other input to each of the AND gates $16_1$ through $16_n$ are the respective decoded timekeeping signals 5-1 through **5-*n* produced by the decoder circuit 4. The AND gates $16_1$ through $16_n$ function as inhibit gates, and in response to a LOW level detecting signal E being applied to the first inputs of each of the AND gates, inhibits or prevents the application of the decoded timekeeping signals produced by the decoder circuit 4 from being applied to the driver circuit 5. Accordingly, when the LOW level detecting signal E is applied to the segment controller circuitry 9, the decoded timekeeping signals 4 are prevented from being applied to the driver circuit 5, and hence, to the liquid crystal display segment electrodes 6**, to thereby insure that the respective liquid crystal display segments are maintained at the same voltage level and polarity as the common electrode thereby effecting a 0 voltage difference across the respective electrodes forming the display cells. Thus, wave detection and control circuitry is provided for detecting the absence of a rectangular wave produced by the divider circuitry and/or oscillator circuit, and in response to detecting the absence of such an alternating signal, prevents the decoded timekeeping signals from being applied to the liquid crystal display cells, to thereby insure that no DC driving of the liquid crystal display cells is effected.

It is noted that the segment controller circuitry could be replaced by switching transistors having their gate electrodes coupled to the output D of the wave detector circuit and their source-drain terminals coupled to receive each of the timekeeping decoder signals. Gating of the decoded timekeeping signals would then be effected by utilizing the voltage level at the capacitor 15 (D) of the wave detector circuit to switch ON and OFF the switcing transistors. Such an approach would equally effect the inhibiting that is obtained by the segment controller circuit 9, depicted in FIG. 6. It is noted that such an arrangement, like the segment controller circuit depicted in FIG. 6, can readily be integrated into the same circuit chip as the decoder circuitry 4 and driving circuitry 5.

It is further noted that the instant invention, although experiencing a small increase in the current consumption of the circuitry, does permit the wave detection and segment control circuitry to be integrated into the same IC chip as the timekeeping and display-driving circuitry. However, this small increase in current consumption is of little significance when compared with the protection offered to the liquid crystal display cell when the oscillator, in the electronic timepiece, ceases to function. Moreover, the detection and control circuitry of the instant invention clearly permits a defective condition in the oscillator current to be readily detected, even if the timepiece does not have a seconds display, since the absence of any energized display segments will immediately indicate, to the wearer, that the operation of the oscillator circuit has resulted.

Moreover, the instant invention permits the digital display panel, and the IC chip, to be formed as a single unit by bonding the IC chip on the liquid crystal display panel. It is apparent that the liquid crystal panel will not be deteriorated in response to the failure of the oscillator circuit to operate, and hence need not be changed when the battery of the timepiece is changed or a portion of the oscillating circuit is fixed or adjusted.

Furthermore, the wave detector and segment control circuitry of the instant invention can be utilized with battery monitoring circuitry in an electronic timepiece in order to prevent current consumption from resulting, since the battery monitoring circuitry is not likely to detect a malfunction in the oscillator circuit and, hence, would continue to charge the digital display cells. However, the instant invention would prevent energization of the display cells and, hence, a drain of the battery when the oscillator circuit ceases to function for a reason other than the supply voltage delivered thereto being reduced. Thus, the instant invention is suitable not only for liquid crystal display cells driven in an AC mode, but for any digital display panels that are required to be driven in an AC mode and will be deteriorated in response to being driven in a DC mode.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An electronic timepiece comprising timekeeping means for producing a plurality of timekeeping signals representative of actual time and a plurality of intermediate frequency signals; decoder means for receiving said plurality of timekeeping signals and in response thereto for producing a plurality of decoded timekeeping signals; driver means for receiving said plurality of decoded timekeeping signals and one of a plurality of intermediate frequency signals and in response thereto producing a plurality of intermediate frequency display drive signals; display means including a common electrode and a plurality of segment electrodes for defining at least one display digit, each said display digit being energized in an AC mode to thereby display actual time in response to an intermediate frequency drive signal applied to a segment electrode and one of said plurality of intermediate frequency signals applied to said common electrode; detecting and controlling means coupled intermediate said decoder means and said driver means for receiving the intermediate frequency signal applied to said common electrode and for inhibiting each of said decoded timekeeping signals from being applied to said driving means to thereby prevent said digital display means from being energized in response to detecting the absence of said intermediate frequency signal applied to said common electrode, said detecting and controlling means including a wave detector means for receiving said intermediate frequency signal applied to said common electrode and in response thereto for detecting the absence of said intermediate frequency signal applied to said common electrode producing a detecting signal, and segment controller means coupled to said wave detector means for receiving said detecting signal and said plurality of decoded timekeeping signals, and in response thereto being adapted to prevent said decoded timekeeping signals from being applied to said driver means to thereby prevent a voltage difference from being effected between the segment electrode and control electrode of each display digit.

2. An electronic timepiece as claimed in claim 1, wherein said detector means includes logic means adapted in response to detecting the absence of said intermediate frequency signal applied to the common electrode within predetermined time interval applying said detecting signal to said segment controller means.

3. An electronic timepiece as claimed in claim 1, wherein said wave detector means includes a first stage for receiving said intermediate frequency signal applied to said common electrode and in response thereto producing a signal of the same frequency but a shorter duty cycle, second stage means adapted to be turned ON during said shortened duty cycle, and third stage means coupled to said second stage means for being charged to a predetermined voltage level in response to said second stage being turned ON, said third stage being permitted to be discharged in response to said second stage being turned OFF, said third stage in response to being discharged over a predetermined interval of time, being adapted to apply said detecting signal to said segment controller means.

4. An electronic timepiece as claimed in claim 3, wherein said first stage includes an inverter and capacitor for receiving said further intermediate frequency signal, and for inverting and delaying same in accordance with the R-C constant defined by said inverter and capacitor, said first stage further including a logic gate means for comparing said further intermediate frequency signal and said inverted and delayed signal, to thereby produce said reduced duty cycle signal.

5. An electronic timepiece as claimed in claim 4, wherein said second stage includes at least one P-channel MOS transistor coupled to receive said reduced duty cycle signal and be turned ON in response to said reduced duty cycle and turned OFF in response to the remainder of said output signal produced by said first stage.

6. An electronic timepiece as claimed in claim 5, wherein said third stage includes a capacitor adapted to be charged when said P-channel transistor of said second stage is turned ON and to be discharged when said P-channel transistor of said second stage is turned OFF.

7. An electronic timepiece as claimed in claim 6, wherein said third stage further includes C-MOS inverter means for detecting when the level of charge of said third stage capacitor drops below the threshold level of said C-MOS inverter stage to thereby produce a detecting signal in response thereto.

8. An electronic timepiece as claimed in claim 1, wherein said segment controller means is a plurality of logic gates having as a first input said detecting signal and as a further input one of said plurality of decoded timekeeping signals, said logic gates inhibiting the transmission of said timekeeping signals to said driving means when said detecting signal is applied thereto.

9. An electronic timepiece as claimed in claim 8, wherein each of said segment controller logic gates are AND gates.

10. An electronic timepiece as claimed in claim 1, wherein the intermediate frequency signal received by said wave detector means is the same as the intermediate frequency signal received by said driver means.

11. An electronic timepiece as claimed in claim 1, wherein said intermediate frequency signal received by said wave detector means has a higher frequency than the intermediate frequency signal received by said driver means.

* * * * *